US010981185B2

(12) United States Patent
Orla-Jensen et al.

(10) Patent No.: US 10,981,185 B2
(45) Date of Patent: Apr. 20, 2021

(54) SYSTEMS AND METHODS FOR TWO-COMPONENT MIXING IN A JETTING DISPENSER

(71) Applicant: NORDSON CORPORATION, Westlake, OH (US)

(72) Inventors: Per Orla-Jensen, Vista, CA (US); Alan R. Lewis, Carlsbad, CA (US); David Padgett, Carlsbad, CA (US)

(73) Assignee: Nordson Corporation, Westlake, OH (US)

( * ) Notice: Subject to any disclaimer, the term of this patent is extended or adjusted under 35 U.S.C. 154(b) by 92 days.

(21) Appl. No.: 15/236,414

(22) Filed: Aug. 13, 2016

(65) Prior Publication Data

US 2018/0043381 A1 Feb. 15, 2018

(51) Int. Cl.

| | |
|---|---|
| ***B05B 7/26*** | (2006.01) |
| ***B05C 11/10*** | (2006.01) |
| ***B05C 9/06*** | (2006.01) |
| ***B05C 5/02*** | (2006.01) |
| ***B01F 11/00*** | (2006.01) |

(Continued)

(52) U.S. Cl.

CPC ..... *B05B 7/26* (2013.01); *B01F 11/0082* (2013.01); *B01F 11/0085* (2013.01); *B05B 1/3013* (2013.01); *B05B 7/0408* (2013.01); *B05B 7/1209* (2013.01); *B05C 5/0225* (2013.01); *B05C 9/06* (2013.01); *B05C 11/1034* (2013.01)

(58) Field of Classification Search

CPC ..... B05B 7/26; B05B 7/0408; B05B 7/1209; B05B 1/3013; B05C 5/0225; B05C 9/06

USPC ..... 239/99, 407–417.5, 583–586

See application file for complete search history.

(56) References Cited

U.S. PATENT DOCUMENTS 3,712,543 A * 1/1973 Clipp ..... B05B 12/06 239/101

4,266,727 A * 5/1981 Happel ..... F02M 43/04 239/409

(Continued)

FOREIGN PATENT DOCUMENTS

CN 201415176 Y 3/2010

CN 105381930 A 3/2016

(Continued)

OTHER PUBLICATIONS

Written Opinion of the International Search Authority dated Oct. 20, 2017 for WO Application No. PCT/US17/045928.

*Primary Examiner* — Viet Le

*Assistant Examiner* — Steven M Cernoch

(74) *Attorney, Agent, or Firm* — BakerHostetler

(57) ABSTRACT

Systems and methods for two-component mixing in a jetting dispenser are provided herein. A jetting dispenser includes a fluid chamber having a first fluid inlet providing a first fluid and a second fluid inlet providing a second fluid, wherein the first fluid and the second fluid mix within the fluid chamber into a mixed fluid. A method for dispensing a mixed fluid from a dispenser having a fluid chamber in fluid communication with first and second fluid inlets is also provided. A first fluid is provided to the fluid chamber via the first fluid inlet and a second fluid is provided to the fluid chamber via the second fluid inlet. At least a portion of a valve element is moved relative to a valve seat to cause dynamic mixing of the first fluid and the second fluid within the fluid chamber to produce the mixed fluid that is dispensed.

44 Claims, 10 Drawing Sheets

(51) Int. Cl.

| | |
|---|---|
| ***B05B 1/30*** | (2006.01) |
| ***B05B 7/04*** | (2006.01) |
| ***B05B 7/12*** | (2006.01) |

(56) References Cited

U.S. PATENT DOCUMENTS 4,453,670 A * 6/1984 Sirovy ..... B29B 7/7438 239/117
4,474,310 A 10/1984 Muller et al.
4,679,711 A * 7/1987 Trevathan ..... B42C 9/0006 137/868
4,708,292 A * 11/1987 Gammons ..... B29B 7/7678 239/414
5,024,385 A * 6/1991 Olson ..... B05B 7/12 239/410
5,048,454 A * 9/1991 Berntsson ..... B05B 15/55 118/302
5,061,454 A * 10/1991 Birk ..... F02B 43/10 239/322
5,211,311 A * 5/1993 Petcen ..... B29B 7/7678 222/145.2
5,299,740 A * 4/1994 Bert ..... B05B 15/5225 239/117
5,372,283 A * 12/1994 Schmitkons ..... B01F 5/045 222/145.6
5,540,388 A * 7/1996 Sasao ..... F02M 51/0678 239/417.3
5,626,292 A * 5/1997 Armaroli ..... F02M 51/0667 239/408
5,979,794 A 11/1999 DeFillipi et al.
6,138,872 A 10/2000 Brennan et al.
6,193,110 B1 * 2/2001 Crebbe ..... B29B 7/761 222/145.1
6,315,161 B1 * 11/2001 Bezaire ..... B29B 7/7678 222/1
6,415,995 B1 * 7/2002 Enderle ..... B01L 3/0268 239/124
6,705,538 B2 3/2004 Fecht et al.
7,296,707 B2 * 11/2007 Raines ..... B05C 5/001 219/422
7,980,483 B2 * 7/2011 Stretch ..... F01M 13/04 239/1
8,210,397 B2 * 7/2012 Joung ..... B01F 5/0615 222/145.5
8,220,725 B2 7/2012 Gressett, Jr. et al.
8,322,575 B2 * 12/2012 Riney ..... B05C 5/0225 222/146.5
8,534,575 B2 9/2013 Brem
8,708,246 B2 4/2014 Dunlap et al.
9,254,642 B2 * 2/2016 Ciardella ..... B41J 2/045
9,346,075 B2 * 5/2016 Aguilar ..... B05C 5/0225
9,636,701 B2 * 5/2017 Abernathy ..... B05C 5/0225
9,808,826 B2 11/2017 Aguilar et al.
2009/0320789 A1 * 12/2009 Lund ..... F02B 69/02 123/299
2010/0252574 A1 * 10/2010 Busin ..... A61C 9/0026 222/137
2013/0048759 A1 * 2/2013 Aguilar ..... B05C 5/0225 239/562
2013/0052359 A1 2/2013 Ahmadi et al.
2013/0105597 A1 * 5/2013 Dunlap ..... G01F 11/021 239/296
2014/0034016 A1 * 2/2014 Acker ..... B05B 7/0815 123/446
2016/0354791 A1 12/2016 Des et al.

FOREIGN PATENT DOCUMENTS

EP 2561932 A2 2/2013
JP 06-226178 A 8/1994

* cited by examiner

SYSTEMS AND METHODS FOR TWO-COMPONENT MIXING IN A JETTING DISPENSER

TECHNICAL FIELD

The present disclosure generally relates to jetting dispensers for depositing small droplets of a viscous fluid onto a substrate, and more specifically, to dispensers of this type that perform two-component mixing.

BACKGROUND

Viscous material dispensers are often used to apply minute amounts of viscous materials, i.e. those with a viscosity exceeding fifty centipoise, onto substrates. As used herein, a "jetting dispenser" refers to a device which ejects, or "jets", a droplet or stream of material from the dispenser to land on a substrate. In particular, the material is deposited on the substrate such that the material disengages with the dispenser nozzle—either before or after contacting the substrate—due primarily to the force of the material being expelled from the dispenser nozzle rather than the surface tension of the material with the substrate.

In a non-contact implementation of a jetting dispenser, the droplet of material disengages from the dispenser nozzle before making contact with the substrate. Thus, in a non-contact jetting dispenser, the droplet dispensed is "in-flight" between the dispenser and the substrate, and not in contact with either the dispenser or the substrate, for at least a part of the distance between the dispenser and the substrate. Although in some uses of a non-contact jetting dispenser, the dispenser may be positioned in close proximity to the substrate, which may cause the dispensed droplet to remain momentarily in contact with the substrate and the dispenser. In other types of jetting dispensers, a stream of material is produced from the dispenser such that the stream of material remains in contact with both the dispenser and the substrate during at least part of a dispensing operation.

Specific applications abound for dispensing viscous materials from a jetting dispenser onto a substrate. In semiconductor package assembly, applications exist for underfilling, solder ball reinforcement in ball grid arrays, dam and fill operations, chip encapsulation, underfilling chip scale packages, cavity fill dispensing, die attach dispensing, lid seal dispensing, no flow underfilling, flux jetting, and dispensing thermal compounds, among other uses. For surface-mount technology (SMT) printed circuit board (PCB) production, surface mount adhesives, solder paste, conductive adhesives, and solder mask materials may be dispensed from jetting dispensers, as well as selective flux jetting.

A jetting dispenser may be employed to dispense a viscous material that was pre-mixed from two base materials before being provided to the jetting dispenser. This two-component mixing may provide additional flexibility in designing specific characteristics of material properties of the resultant mixed material, thus affording better overall material performance. Yet, one challenge arising from the use of pre-mixed materials in jetting dispensers is that the pre-mixed material is subject to a change in viscosity during dispensing due to material pot life limitations. The change in viscosity may thus affect the flow characteristics of the pre-mixed material in the jetting dispenser, which, in turn, may cause the jetting dispenser to apply an incorrect volume of material to a substrate.

For at least these reasons, it would be desirable to provide systems and methods for two-component mixing in a jetting dispenser.

SUMMARY

Disclosed herein are system and methods for two-component mixing in a jetting dispenser. In one aspect, a jetting dispenser may include a fluid chamber having a first fluid inlet providing a first fluid and a second fluid inlet providing a second fluid, wherein the first fluid and the second fluid mix within the fluid chamber into a mixed fluid. The jetting dispenser may further include a valve seat with an opening communicating with the fluid outlet and a poppet disposed within the fluid chamber, the poppet configured with a valve element. The jetting dispenser may further include a drive member configured to reciprocally move at least a portion of the poppet and valve element relative to the valve seat to cause a droplet of the mixed fluid to be jetted from the fluid outlet.

In an aspect, the reciprocal movement of the valve element may cause the mixing of the first fluid and the second fluid within the fluid chamber. Further, the reciprocal movement of the valve element may cause at least a portion of the mixed fluid disposed between the valve element and the valve seat to be displaced within the fluid chamber in an upward direction away from the valve seat.

In another aspect, the fluid chamber may include a side wall and one or more protrusions disposed on the side wall. The protrusions disposed on the side wall of the fluid chamber may include a pin or an annular vane.

In another aspect, the poppet or the body defining the fluid chamber may rotate relative to one another to cause the mixing of the first fluid and the second fluid within the fluid chamber. In one aspect, the poppet is configured to rotate about a longitudinal axis of the poppet while the body of the fluid chamber is stationary. The poppet may be configured to rotate in a first direction during a movement toward the valve seat and in a second direction, opposite the first direction, during a movement away from the valve seat. In an aspect, the body of the fluid chamber may be configured to rotate about a longitudinal axis of the body of the fluid chamber while the poppet is rotationally stationary.

In yet another aspect, the poppet may be configured with one or more static elements protruding from a surface of the poppet. Each of the one or more static elements protruding from the surface of the poppet may include a cork screw surface, parallel annular vanes circumscribing the surface of the poppet, or a pin.

In another aspect, the fluid chamber may be further configured with a rotating member such that the rotating member rotates circumferentially about the poppet. The rotation of the rotating member may be at least partially caused by an activation of the solenoid, which may be disposed external to the fluid chamber. The rotating member may be configured in a ring shape surrounding the poppet. In some aspects, the rotating member may be positioned at a top portion of the fluid chamber proximate a junctions of a fluid channel and the fluid chamber. In other aspects, at least a portion of the rotating member may be positioned in a recess in a side wall of the fluid chamber. Further, a surface of the rotating member may be configured with one or more static protrusions. The one or more static protrusions may be disposed on a top surface of the rotating member. Each of the one or more static protrusions may comprise a fin, which may be oriented such that the planar surface of the fin is perpendicular to a rotational direction of the rotating member when rotated about the poppet.

In a further aspect, the first fluid inlet and the second fluid inlet may be disposed on opposite ends of a fluid channel in fluid communication with the fluid chamber.

In another aspect, the first fluid inlet may include a first metering device configured to control flow of the first fluid and the second fluid inlet may include a second metering device configured to control flow of the second fluid. The first and second metering devices may each comprise a pump or a valve.

Further, a method is provided for dispensing a mixed fluid from a dispenser having a fluid chamber in fluid communication with first and second inlets, a fluid outlet from the fluid chamber, a valve seat with an opening communicating with the fluid outlet, a valve element disposed within the fluid chamber, and a drive member configured to reciprocally move at least a portion of the valve element relative to the valve seat. The method may include providing a first fluid to the fluid chamber via the first inlet and providing a second fluid to the fluid chamber via the second inlet. The method may further include moving, via the drive member, at least a portion of the valve element relative to the valve seat to cause dynamic mixing of the first fluid and the second fluid within the fluid chamber to produce the mixed fluid that is dispensed from the fluid outlet.

A dispenser for fluid materials is also provided herein. The dispenser may include a fluid chamber in fluid communication with a first fluid inlet providing a first fluid and a second fluid inlet providing a second fluid. The dispenser may include a fluid outlet from the fluid chamber, a valve seat with an opening communicating with the fluid outlet, and a valve element disposed within the fluid chamber. The dispenser may additionally include a drive member configured to reciprocally move at least a portion of the valve element relative to the valve seat to cause dynamic mixing of the first fluid and the second fluid within the fluid chamber to produce a mixed fluid that is dispensed from the fluid outlet.

Various additional features and advantages will become more apparent to those of ordinary skill in the art upon review of the following detailed description of the illustrative embodiments taken in conjunction with the accompanying drawings.

BRIEF DESCRIPTION OF THE DRAWINGS

The following detailed description is better understood when read in conjunction with the appended drawings. For the purposes of illustration, examples are shown in the drawings; however, the subject matter is not limited to the specific elements and instrumentalities disclosed. In the drawings.

DETAILED DESCRIPTION

Figure 1:
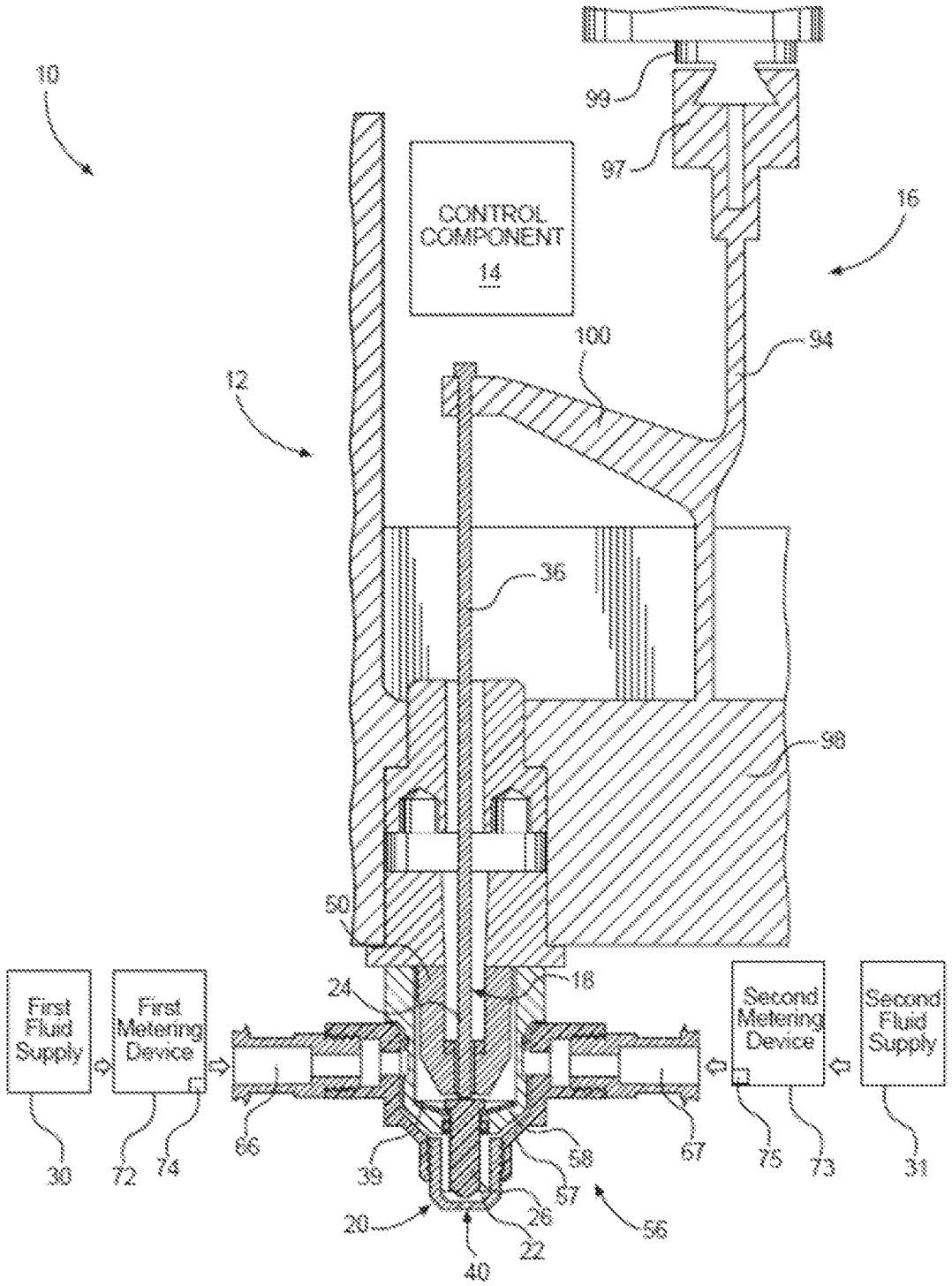
FIG. 1 illustrates a cross-sectional view of a jetting system according to an embodiment of the present disclosure.
Figure 1A:
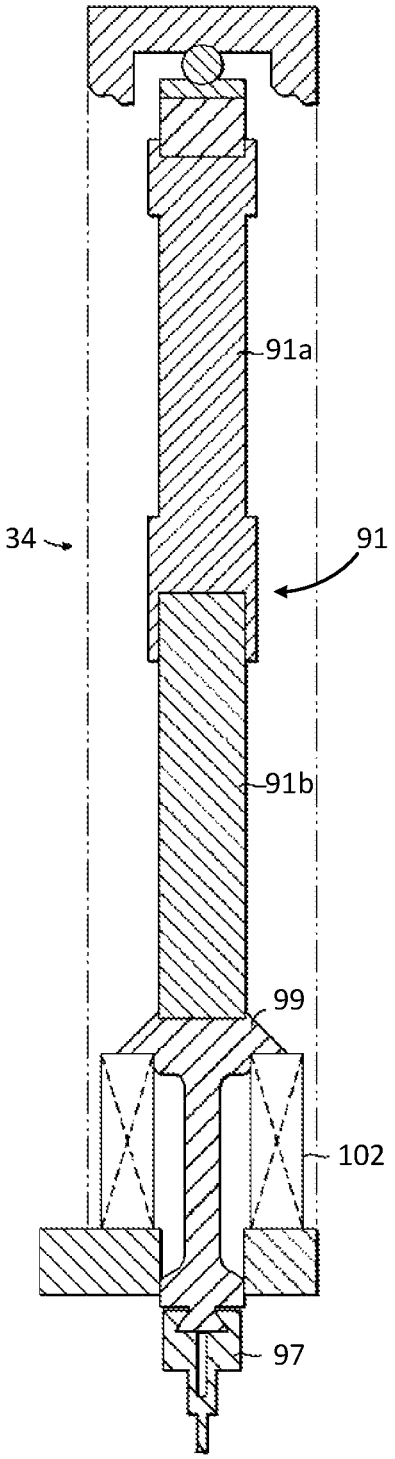
FIG. 1A illustrates a cross-sectional view of a piezoelectric actuator according to an embodiment of the present disclosure.
Figure 2:
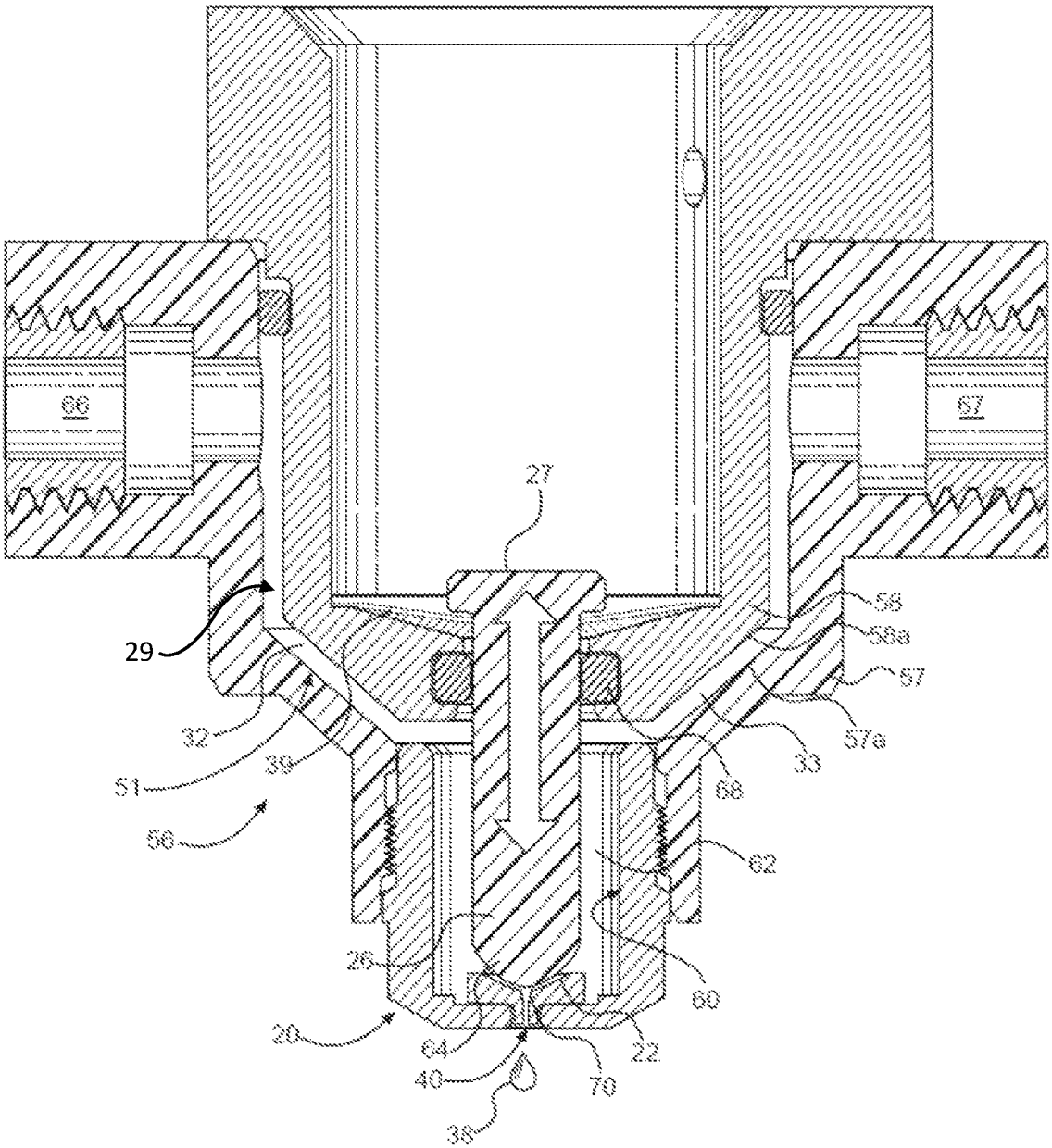
FIG. 2 illustrates a close-up cross-sectional view of a fluid cartridge of a jetting system according to an embodiment of the present disclosure.

Referring to FIGS. 1, 1A, and 2, a dispensing system 10 in accordance with an embodiment generally includes a dispenser 12 (e.g., a jetting dispenser) operatively coupled with a control component 14. The dispenser 12 includes an actuation mechanism 16, a valve closure structure 18, and a fluid cartridge 56 out of which a mixed fluid 38 is dispensed. Specifically, as shown in FIG. 1, the valve closure structure 18 includes a drive pin 36 and a poppet 26 actuated by the actuation mechanism 16 to engage a valve seat 22 of the fluid cartridge 56. As will be described in further detail below, the dispenser 12 receives a first fluid from a first fluid supply 30 and a second fluid (different from the first fluid) from a second fluid supply 31, whereby the first fluid and the second fluid are mixed in a fluid chamber 62 of the fluid cartridge 56 to form the mixed fluid 38 to be dispensed.

In the dispenser 12 depicted in the figures, the actuation mechanism 16 employs a piezoelectric actuator 34 to reciprocally actuate the drive pin 36. In other embodiments, however, the actuation mechanism 16 may be formed from other types of actuators, such as a pneumatic actuator or an electromechanical solenoid. The actuation mechanism 16 includes the piezoelectric actuator 34 having piezoelectric stacks 91*a*, 91*b* (hereinafter referred to collectively as the piezoelectric stack 91), a plunger 99, and an asymmetrical flexure 94. The flexure 94 is an integral part of an actuator body 98, within which the actuation mechanism 16 is generally disposed, and includes a coupling element 97 that connects the flexure 94 to the plunger 99. A spring 102 within the piezoelectric actuator 34 applies a spring force to the plunger 99 and piezoelectric stack 91 to keep them in compression.

The plunger 99 functions as a mechanical interface connecting the piezoelectric stack 91 with the asymmetrical flexure 94. The spring 102 is compressed in the assembly such that the spring force generated by the spring 102 applies a constant load on the piezoelectric stack 91, which preloads the piezoelectric stack 91. The asymmetrical flexure 94, which may be comprised of a metal, has an arm 100 that is physically secured with an end of the drive pin 36 opposite to the tip 24 of the drive pin 36. The asymmetrical flexure 94 functions as a mechanical amplifier that converts the relatively small displacement of the piezoelectric stack 91 into a useful displacement for the drive pin 36 that is significantly larger than the displacement of the piezoelectric stack 91.

The piezoelectric stack 91 of the piezoelectric actuator 34 is a laminate comprised of layers of a piezoelectric ceramic that alternate with layers of a conductor as is conventional in the art. The spring force from spring 102 maintains the laminated layers of the piezoelectric stack 91 in a steady state of compression. The conductors in the piezoelectric stack 91 are electrically coupled with a driver circuit of the control component 14, which supplies current-limited output signals, in a manner well known in the art, with pulse width modulation, frequency modulation, or a combination thereof. When power is periodically supplied from the driver circuit, electric fields are established that change the dimensions of the piezoelectric ceramic layers in the piezoelectric stack 91.

The dimensional changes experienced by the piezoelectric stack 91, which are mechanically amplified by the asymmetrical flexure 94, move the drive pin 36 linearly in a direction parallel to its longitudinal axis. When the piezoelectric ceramic layers of the piezoelectric stack 91 expand, the spring 102 is compressed by the force of the expansion and the asymmetrical flexure 94 pivots about a fixed pivot axis to cause movement of the tip 24 of the drive pin 36 upward and away from the poppet 26. This allows a biasing element 39 to move a valve element 64 of the poppet 26 away from valve seat 22. The drive pin 36 is guided using a drive pin guide 50. When the actuation force is removed and the piezoelectric ceramic layers of the piezoelectric stack 91 are permitted to contract, the spring 102 expands and the asymmetrical flexure 94 pivots to move the drive pin 36 downward so that the tip 24 of the drive pin 36 moves into contact with the poppet 26, causing the valve element 64 to contact valve seat 22 and jet a droplet of material. Thus, in the de-energized state, the piezoelectric actuator 34 maintains the valve in a normally closed position. In operation, the asymmetrical flexure 94 intermittently rocks in opposite directions about a fixed pivot axis as the piezoelectric stack 91 is energized and de-energized to move the tip 24 of the drive pin 36 into and out of contact with the poppet 26 to jet droplets of material at a rapid rate.

FIG. 2 shows a detailed view of the dispenser 12 and, in particular, the fluid cartridge 56. The fluid cartridge 56 includes an outer cartridge body 57 coupled with an inner cartridge body 58. A nozzle hub 20 is removably coupled with the outer cartridge body 57 (although in other aspects, the nozzle hub 20 may be non-removably coupled with the outer cartridge body 57). The inner side walls 60 of the nozzle hub 20 define a fluid chamber 62 in which the first and second fluids are mixed to form the mixed fluid 38 and from which the mixed fluid 38 is dispensed. It will be noted that the tip 24 of the drive pin 36 and the drive pin guide 50 are not depicted in FIGS. 2-8.

The first and second fluids are provided from the first fluid supply 30 and the second fluid supply 31, respectively. In particular, the first fluid supply 30 is in fluid communication with a first fluid inlet 66 and the second fluid supply 31 is in fluid communication with a second fluid inlet 67. The first fluid inlet 66 and the second fluid inlet 67 each open to a fluid channel 29. For example, the first fluid inlet 66 may open to a first side 32 of the fluid channel 29 and the second fluid inlet 67 may open to a second side 33 (e.g., opposite the first side 32) of the fluid channel 29.

In some embodiments, a third fluid inlet (not shown) may open to the fluid channel 29 for purposes of providing a suitable solvent or other material for cleaning or purging the fluid cartridge 56 of remnant material. In the embodiment shown in FIGS. 1 and 2, the fluid channel 29 is disposed above and adjacent to the fluid chamber 62 and defined by the inner walls 57*a* of the outer cartridge body 57 and the outer walls 58*a* of the inner cartridge body 58. Thus, the fluid channel 29 forms a cylindrical and substantially contiguous channel around the circumference of at least a portion of the inner cartridge body 58. The lower portion of the fluid channel 29 is configured in a funnel structure 51 to guide the first and second fluids into the fluid chamber 62. Due to the contiguous nature of the fluid channel 29, it will be appreciated that some partial mixing of the first and second fluids may occur, but the first and second fluids will not fully mix until entering the fluid chamber 62 and undergoing one or more of the various means of mixing the first and second fluids described in detail herein. It is also explicitly contemplated that the first and second fluids may be simultaneously introduced to the fluid channel 29 and/or the fluid chamber 62 via a single inlet, such that the first and second fluids may simultaneously flow in the singlet inlet together but also not fully mix until reaching the fluid chamber 62.

In an alternative embodiment (not shown) of the fluid cartridge 56, the fluid channel 29 is not contiguous around the circumference of the inner cartridge body 58 but is instead configured as two discrete fluid channels. Thus, one of the discrete fluid channels leads from the first fluid inlet 66 to the fluid chamber 62 to supply the first fluid. Another of the discrete fluid channels leads from the second fluid inlet 67 to the fluid chamber 62 to supply the second fluid.

In another alternative embodiment (not shown) of the fluid cartridge 56, the fluid channel 29 may be configured as helical fluid channels, as described in Applicant's U.S. patent application Ser. No. 14/730,522, filed Jun. 4, 2015, entitled "Jet Cartridges for Jetting Fluid Material, and Related Methods", which is hereby incorporated by reference.

With particular attention to FIG. 1, the first and second fluids supplied to the fluid chamber 62 may be independently metered according to, for example, a desired ratio of the first and second fluids comprising the mixed fluid 38. The metering of the first and second fluids may be effectuated by operation of a first metering device 72 in the first fluid inlet 66 and a second metering device 73 in the second fluid inlet 67. In an aspect, the first metering device 72 and the second metering device 73 may not be positioned directly in the first fluid inlet 66 and the second fluid inlet 67, respectively, but may be positioned upstream of the first fluid inlet 66 and the second fluid inlet 67, respectively, and downstream of the first fluid supply 30 and the second fluid supply 31, respectively.

The first metering device 72 and the second metering device 73 may each comprise, for example, a pump. A pump may be a progressive cavity pump (PCP), a piston pump, a gear pump, or any other mechanism for moving a fluid. Additionally or alternatively, the first metering device 72 and the second metering device 73 may comprise a valve operable to regulate the flow of fluid to the respective first fluid inlet 66 and the second fluid inlet 67. A first sensor 74 and a second sensor 75 may be used in conjunction with the respective first metering device 72 and second metering device 73 to measure the volume and/or flow rate of fluid being supplied to the respective first fluid inlet 66 and second fluid inlet 67. The first metering device 72, the second metering device 73, the first sensor 74, and the second sensor 75 may each be communicatively connected to the control component 14. Accordingly, the control component 14 may vary the operation (e.g., flow rate) of the first metering device 72 and/or second metering device 73 to achieve the desired ratio of first and second fluids supplied to the fluid chamber 62.

Referring back to FIG. 2, the dispenser 12 is configured with the valve closure structure 18 at least partially disposed within the fluid chamber 62. For example, the poppet 26 of the valve closure structure 18 is substantially disposed within the fluid chamber 62. The poppet 26 is actuated, such as by the actuation mechanism 16 via the tip 24 of the drive pin 36 as shown in FIG. 1. The poppet 26 is configured at its top portion with a surface 27 by which the tip 24 of the drive pin 36 engages the poppet 26. For example, the tip 24 of the drive pin 36 may be reciprocally actuated and, on a downward reciprocation, the tip 24 of the drive pin 36 may engage or contact the surface 27 of the poppet 26 to impart a corresponding downward reciprocation to the poppet 26. Following a downward reciprocation, the biasing element 39 urges the poppet 26 back upwards to the poppet's 26 starting position. A sealing member 68, such as a rubber O-ring, may be used to fluidly isolate the drive pin 36 and the top portion of the poppet 26 from the fluid chamber 62.

A lower portion of the poppet 26 (i.e., the portion of the poppet 26 situated within the fluid chamber 62) is configured with a valve element 64. Upon a downward reciprocation of the poppet 26, the valve element 64 engages the valve seat 22 disposed in the fluid chamber 62 and having an opening 70 in fluid communication with the outlet 40. As the valve element 64 moves towards and engages the valve seat 22, at least some of the fluid (e.g., the mixed fluid 38) situated therebetween is forced through the opening 70 of the valve seat 22 and out of the outlet 40. The reciprocating actuation of the poppet 26 and valve element 64 may be repeated in rapid succession to cause a successive series of droplets of mixed fluid 38 to be dispensed from the dispenser 12. To the extent that the fluid supplied to the fluid chamber 62 may be pressurized, this pressure is sufficient to fill in the area between the valve element 64 and the valve seat 22 during an upward reciprocation of the poppet 26 and valve element 64, but insufficient to cause fluid to pass through the opening 70 of the valve seat 22. That is, no fluid is dispensed while the poppet 26 is in an upward reciprocation or the dispenser 12 is otherwise not in operation.

As described above, the first fluid and the second fluid are provided to the fluid chamber 62 in a generally unmixed state and mixed to form the mixed fluid 38, which is dispensed from the outlet 40. In the various embodiments described herein, the first fluid and the second fluid are mixed, via one or more mechanisms, within the fluid chamber 62 to form the mixed fluid 38. In the first embodiment shown in FIG. 2, the first and second fluids are mixed in the fluid chamber 62 by the reciprocal movement of the poppet 26 and valve element 64.

Starting from a position in which the valve element 64 is engaged with the valve seat 22, the poppet 26 and valve element 64 move upward and out of engagement with the valve seat 22. As the poppet 26 and valve element 64 move upward, fluid (e.g., already mixed fluid 38 and/or a partial mixture of the first and second fluids) within the fluid chamber 62 fills in the space between the valve element 64 and the valve seat 22 and previously occupied by the poppet 26 and valve element 64. After reaching a maximum upward position, the poppet 26 and valve element 64 move downward toward the valve seat 22. As the poppet 26 and valve element 64 move downward toward the valve seat 22, and ultimately into engagement with the valve seat 22, a portion of the fluid between the valve element 64 and the valve seat 22 is forced through the opening 70 of the valve seat 22 and dispensed from the outlet 40. Yet, another portion of the fluid between the valve element 64 and the valve seat 22 is displaced outward from the engagement of the valve element 64 and the valve seat 22 and toward the periphery of the fluid chamber 62 (i.e., toward the inner side walls 60 of the nozzle hub 20). The outward displacement of fluid, in turn, causes an upward displacement and turbulence in at least a portion of the remainder of fluid in the fluid chamber 62. The turbulence is particularly pronounced due to the collision of the upward-moving fluid displaced by the reciprocation of the poppet 26 and valve element 64 and the downward-moving first and second fluids provided from the fluid channel 29. This displacement and turbulence thus provide a mixing effect to the first and second fluids to form the mixed fluid 38.

Figure 3:
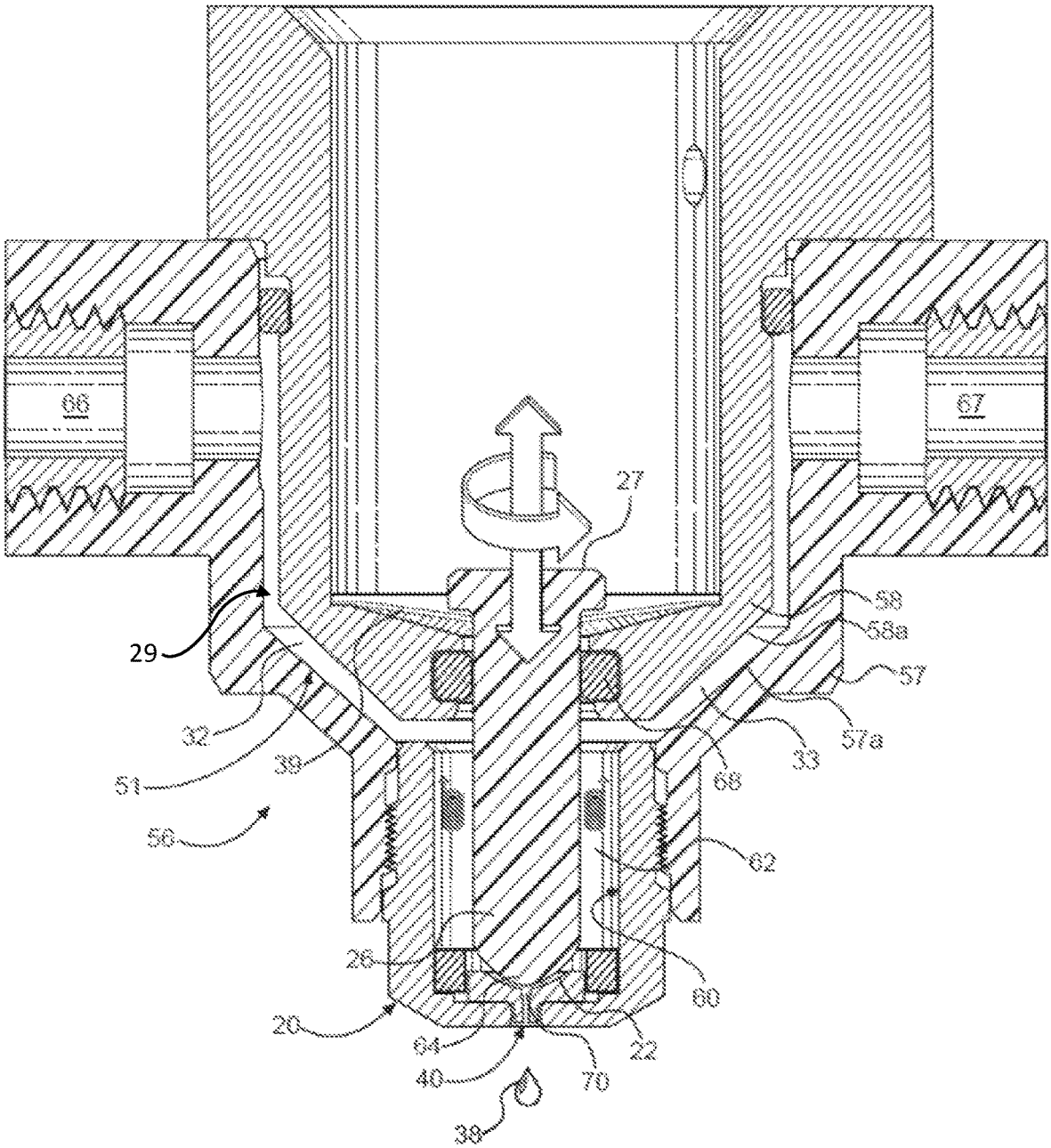
FIG. 3 illustrates a close-up cross-sectional view of a fluid cartridge of a jetting system according to an embodiment of the present disclosure.

FIG. 3 illustrates a second embodiment of the fluid cartridge 56 also configured similarly in some respects to that shown in FIG. 2. Therefore, like reference numerals are used for like elements. Generally, the fluid cartridge 56 may be configured such that at least one of the poppet 26 (and valve element 64) or the fluid chamber 62 rotate relative to one another to cause, at least in part, the first and second fluids to mix and form the mixed fluid 38. In particular, the poppet 26—and thus also the valve element 64—are configured to rotate about the longitudinal axis of the poppet 26 while the poppet 26 is reciprocated. In an aspect, the rotation of the poppet 26 and the reciprocation of the poppet 26 may be coordinated. For example, over the course of a downward reciprocation of the poppet 26 (e.g., from the maximum upward position of the poppet 26 to the position of the poppet 26 at which the valve element 64 engages the valve seat 22) the poppet 26 may rotate in a first direction a pre-determined amount, such as one full clockwise rotation. Accordingly, over the course of the subsequent upward reciprocation of the poppet 26 (e.g., from the position of the poppet 26 at which the valve element 64 engages the valve seat 22 to the maximum upward position of the poppet 26) the poppet 26 may rotate in a second direction opposite the first direction a pre-determined amount, such as one full counter-clockwise rotation. The rotation of the poppet 26 and valve element 64 will generate further turbulence in the fluid and thus cause, at least in part, the first and second fluids to mix and form the mixed fluid 38.

In another aspect, the nozzle hub 20 or other structure defining the fluid chamber 62 may be configured to rotate about the nozzle hub's 20 (or other structure's) longitudinal axis, which in most instances will also coincide with the longitudinal axis of the poppet 26. The nozzle hub 20 may rotate while the poppet 26 is rotationally stationary or while the poppet 26 also rotates. In aspects in which both the nozzle hub 20 and the poppet 26 rotate, the nozzle hub 20 may rotate in an opposite direction of that of the poppet 26 or the nozzle hub 20 may rotate in the same direction as that of the poppet 26. In yet another aspect, the poppet 26 may be rotationally free-floating, meaning that the poppet 26 is not fixed at any particular rotational position.

Figure 4:
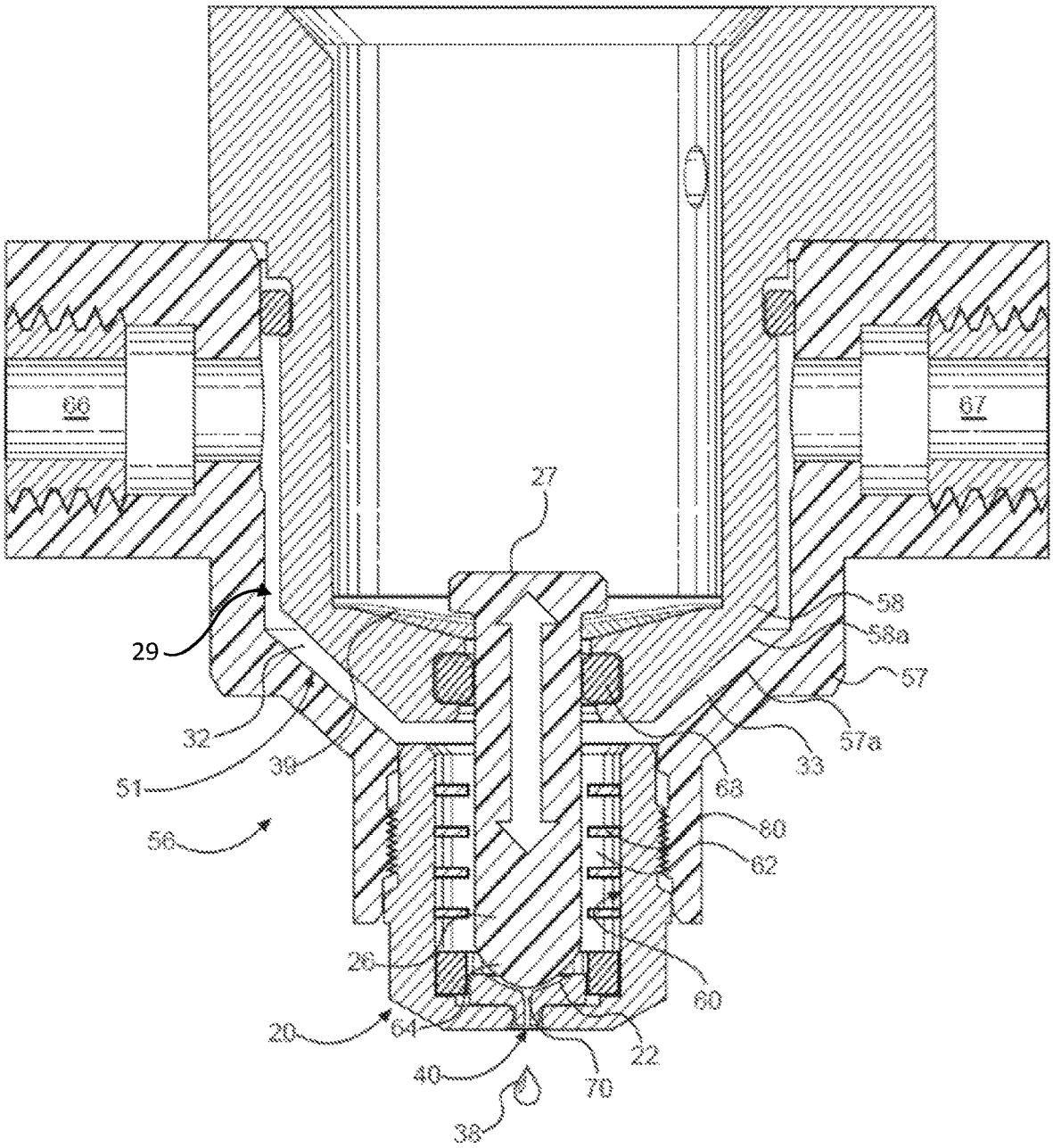
FIG. 4 illustrates a close-up cross-sectional view of a fluid cartridge of a jetting system according to an embodiment of the present disclosure.

FIG. 4 illustrates a third embodiment of the fluid cartridge 56. The fluid cartridge 56 shown in FIG. 4 is configured similarly to that shown in FIG. 2 in some respects. Therefore, like reference numerals are used for like elements. In this embodiment, a plurality of static protrusions 80 are disposed on the inner side walls 60 of the nozzle hub 20 and protrude into the fluid chamber 62. The static protrusions 80 may take the form of annular vanes, pins, or other static structures (and combinations thereof) that provide a mixing effect to the fluid in the fluid chamber 62 as the fluid moves in the fluid chamber 62. For example, static protrusions 80 configured as annular vanes, as depicted in FIG. 4, will cause a folding effect to a fluid flowing over the annular vanes, thereby mixing the first and second fluids into the mixed fluid 38. The movement over the static protrusions 80 may be caused by the downward flow of the first and second fluids from fluid channel 29. Further, the movement of fluid over the static protrusions 80 may be caused by the upward flow of fluid generated by the reciprocation of the poppet 26 and valve element 64, as described above with respect to the embodiment illustrated in FIG. 2.

Figure 5:
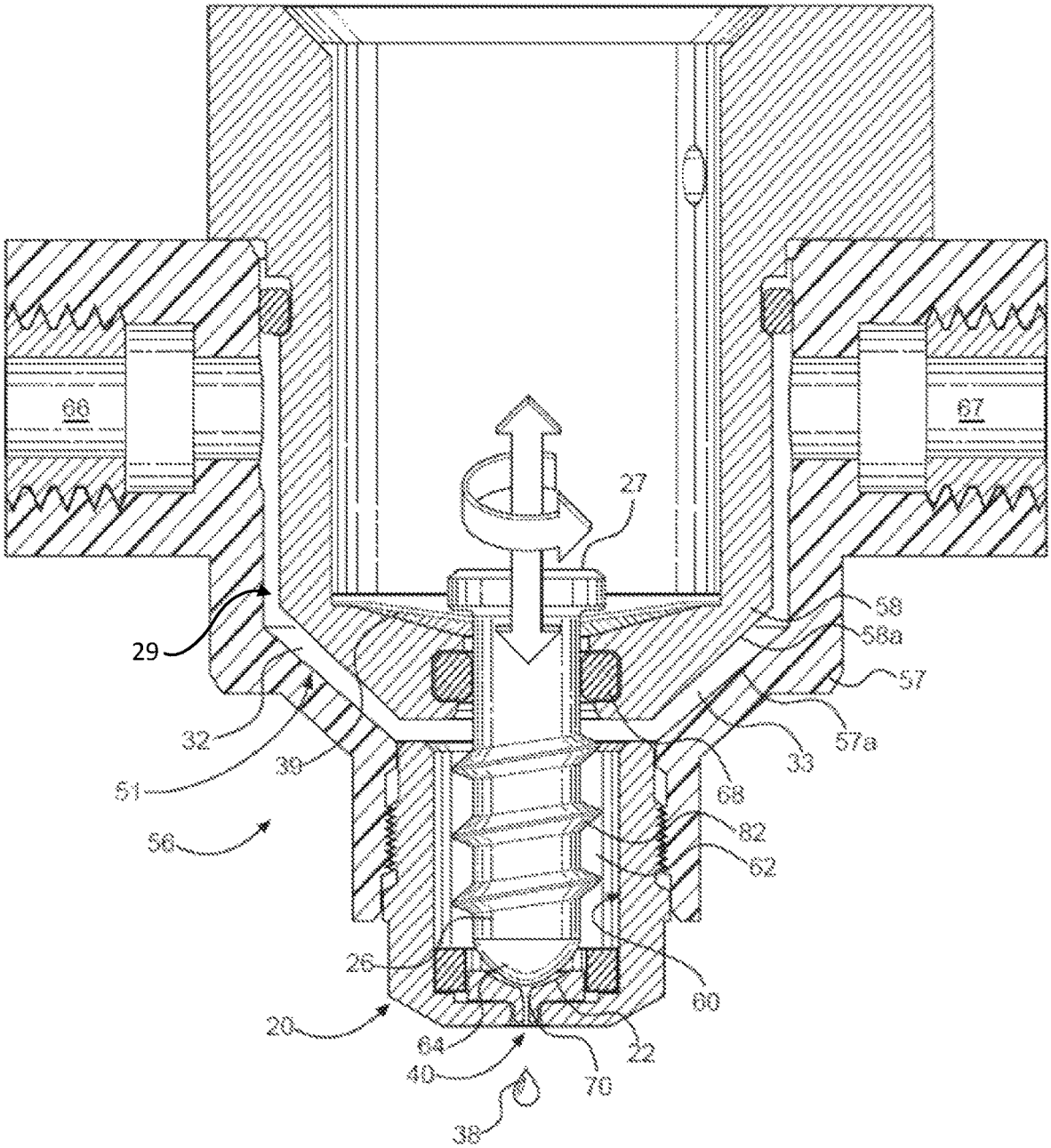
FIG. 5 illustrates a close-up cross-sectional view of a fluid cartridge of a jetting system according to an embodiment of the present disclosure.

FIG. 5 illustrates a fourth embodiment of the fluid cartridge 56 also configured similarly in some respects to that shown in FIG. 2. Therefore, again, like reference numerals are used for like elements. In general, the poppet 26 may be configured with one or more static elements 82 to further aid in mixing the first fluid and the second fluid to form the mixed fluid 38. More particularly, and as depicted in FIG. 5, the poppet 26 is configured with static elements 82 in the form of a cork screw surface. As the poppet 26 reciprocates, the cork screw surface produces a mixing effect, such as turbulence, to the fluid in the fluid chamber 62. Another form of static elements 82 may include one or more parallel annular vanes circumscribing the surface of the poppet 26, wherein the plane of each of the annular vanes is perpendicular to the longitudinal axis of the poppet 26. Yet another form of the static elements 82 may include one or more pins attached to the surface of the poppet 26. In some aspects, the static elements 82 on the poppet 26 may be used in conjunction with a poppet 26 configured to reciprocate without rotation. In other aspects, the poppet 26 may be configured with the static elements 82 and also rotate during reciprocation, as described above in relation to the embodiment shown in FIG. 3.

Figure 6:
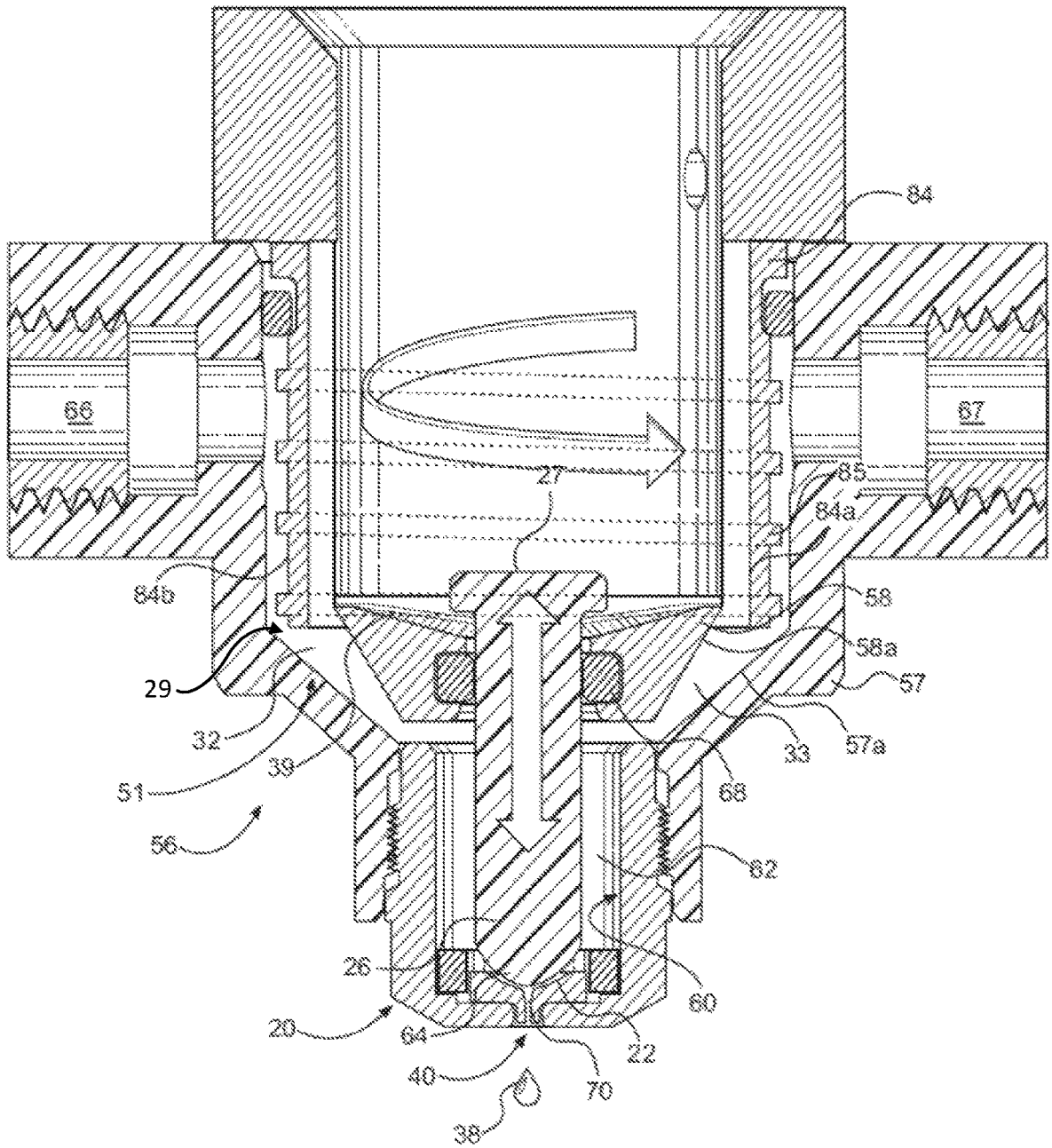
FIG. 6 illustrates a close-up cross-sectional view of a fluid cartridge of a jetting system according to an embodiment of the present disclosure.

FIG. 6 illustrates a fifth embodiment of the fluid cartridge 56 in which the fluid cartridge 56 is configured similarly in some respects to that depicted in FIG. 2. Therefore, like reference numerals are used for like elements. In general, this embodiment of the fluid cartridge 56 is configured such that the inner cartridge body 58 is configured with a rotating portion 84 to further provide a mixing effect to the first and second fluids. The rotating portion 84 is situated in the fluid channel 29, which in this embodiment encompasses the space both on the inside and outside of the rotating portion 84. The rotating portion 84 is formed in a cylindrical shape and surrounds the inner components of the fluid cartridge 56, such as the tip 24 of the drive pin 36 and drive pin guide 50 (neither being shown in FIG. 6). In one aspect, the rotating portion 84 may be rotatably coupled to the remainder portions of the inner cartridge body 58. In another aspect, the rotating portion 84 may be free-floating.

The rotating portion 84 may be configured with one or more static elements to facilitate mixing. For example, the embodiment of the rotating portion 84 shown in FIG. 6 is configured with a cork screw surface 85 on the outside surface 84*b* of the rotating portion 84.

In operation, the rotating portion 84 of the inner cartridge body 58 is rotated about a longitudinal axis of the rotating portion 84. This rotation of the rotating portion 84 may provide a level of pre-mixing of the first and second fluids in the fluid channel 29 before the first and second fluids flow to the fluid chamber 62 to be fully mixed into the mixed fluid 38. The rotation of the rotating portion 84 may be effectuated via one or more solenoids positioned, for example, in the outer cartridge body 57. The use of solenoids to rotate a component is discussed more fully below in relation to the embodiments of FIGS. 7 and 8. Other mechanisms for rotating the rotating portion 84 may additionally or alternatively be employed, such as a pneumatic mechanism, an electromagnetic mechanism, or an electromechanical mechanism. In an alternative embodiment, the rotating portion 84 may be reciprocated up and down (i.e., moved along the longitudinal axis of the rotating portion 84) instead of or in addition to rotating.

In an alternative embodiment, the body (e.g., the nozzle hub 20) defining the fluid chamber 62 is rotated about a longitudinal axis of the body to facilitate the mixing of the first and second fluids in the fluid chamber 62.

Figure 7:
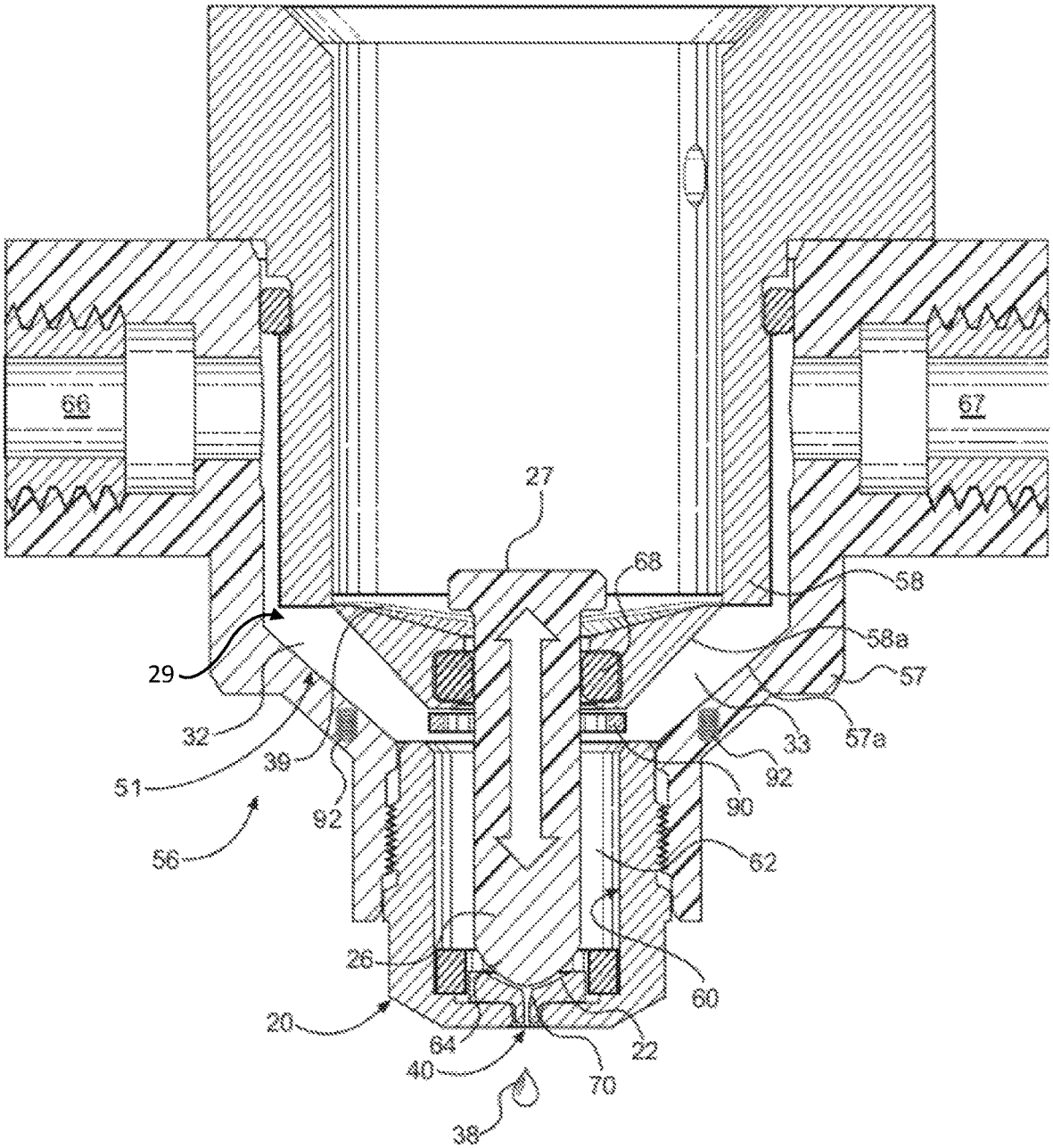
FIG. 7 illustrates a close-up cross-sectional view of a fluid cartridge of a jetting system according to an embodiment of the present disclosure.
Figure 8:
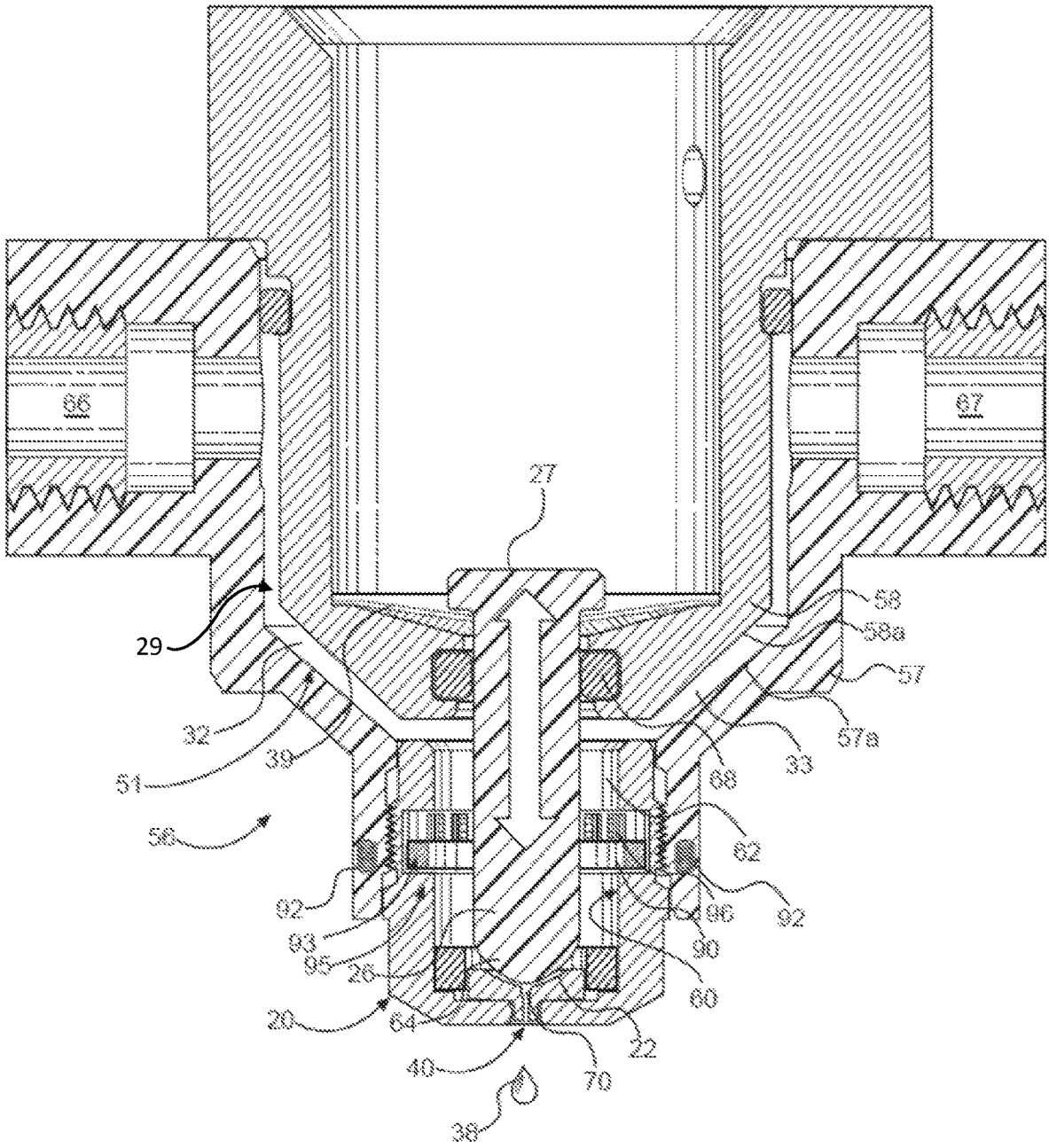
FIG. 8 illustrates a close-up cross-sectional view of a fluid cartridge of a jetting system according to an embodiment of the present disclosure.

FIGS. 7 and 8 depict sixth and seventh embodiments of the fluid cartridge 56 also configured similarly in some respects to that shown in FIG. 2. Therefore, again, like reference numerals are used for like elements. The embodiments shown in FIGS. 7 and 8 generally include a rotating member 90 positioned in the fluid chamber 62 that is caused to rotate and mix the first and second fluids to form the mixed fluid 38. The rotating member 90 may be comprised, at least in part, of a magnetic material and formed in a ring shape surrounding the poppet 26. The rotating member 90 comprised of a magnetic material may be rotated by operation of one or more solenoids 92 disposed in or on the fluid cartridge 56, such as in the outer cartridge body 57 or the nozzle hub 20. The solenoids 92 may be communicatively connected to and controlled by the control component 14, thereby allowing the degree of mixing afforded by the rotating member 90 to be dynamically adjusted, such as by adjusting the rotational speed of the rotating member 90, according to present needs relating to viscosity, flow rate, volume, etc.

In the embodiment of FIG. 7, the fluid channel 29 is enlarged to accommodate the rotating member 90 positioned in the top portion of the fluid chamber 62 near the junctions of the fluid chamber 62 with the fluid channel 29. In an aspect, the rotating member 90 is not directly affixed to any element of the fluid cartridge 56, but is instead free-floating in the fluid chamber 62. In another aspect, the rotating member 90 is rotatably coupled with another component of the fluid cartridge 56, such as the poppet 26 or the inner cartridge body 58. The rotation of the rotating member 90 is effectuated by the pair of solenoids 92 situated in the outer cartridge body 57 adjacent the rotating member 90. Further, the rotating member 90 is positioned such that the direction of rotation is perpendicular to the longitudinal axis of the poppet 26.

In the embodiment of FIG. 8, the rotating member 90 is positioned at a middle portion of the fluid chamber 62. An outer circumferential portion 93 of the rotating member 90 is positioned in a recess 95 in the inner side wall 60 of the nozzle hub 20. In some aspects, the inner side walls 60 of the nozzle hub 20 may be configured without the recess 95 and the rotating member 90 may be fully situated in the fluid chamber 62. As described above with respect to the embodiment of FIG. 7, the rotating member 90 is formed in a ring shape and surrounding the poppet 26. The rotating member 90 may be movably supported, such as by the recess 95, or may be free-floating. Further, the rotating member 90 may be comprised, at least in part, of a magnetic material and may, accordingly, be rotated by operation of the solenoids 92 disposed in the outer cartridge body 57. In other aspects, the solenoids 92 may be disposed in the nozzle hub 20 or other portion of the fluid cartridge 56.

The rotating member 90 may further be configured with one or more static elements protruding from the top, side, or bottom surface of the rotating member 90. For example, as depicted in FIG. 8, a plurality of fins 96 are fixed to the top surface of the rotating member 90. Each of the plurality of fins 96 are oriented such that the planar surface of the fin 96 is generally perpendicular to the circumference—and a direction of rotation—of the rotating member 90. In other words, the planar surface of each of the plurality of fins 96 runs parallel to the corresponding radius of the rotating member 90. In other aspects, the relative angle between the planar surface of each of the plurality of fins 96 and the corresponding radius of the rotating member 90 may be forty-five degrees. As the rotating member 90 is rotated in the fluid chamber 62, the plurality of fins 96 further cause, at least in part, the first fluid and the second fluid to mix and form the mixed fluid 38.

It will be appreciated that the various embodiments of the fluid cartridge 56 described herein may be combined in some aspects. For example, the static protrusions 80 on the inner side walls 60 of the nozzle hub 20 depicted in FIG. 4 may be combined in an aspect with the poppet 26 configured with static elements 82 depicted in FIG. 5.

Figure 9:
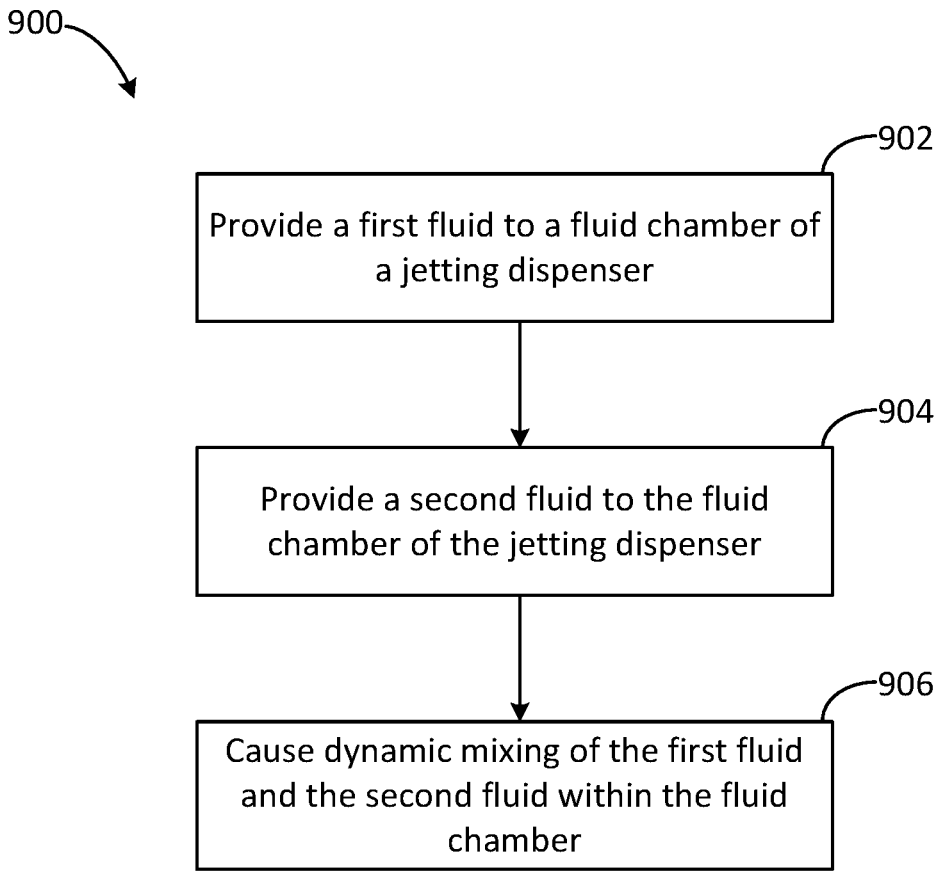
FIG. 9 illustrates a flow diagram of an exemplary method of two-component mixing in a non-contact jetting dispenser according to an embodiment of the present disclosure.

FIG. 9 illustrates an exemplary method 900 for performing two-component mixing in a jetting dispenser. At step 902, a first fluid is provided to a fluid chamber of a jetting dispenser. For example, with additional reference to FIGS. 1 and 2, the first fluid may be provided to the fluid chamber 62 of the dispenser 12 from the first fluid supply 30 via the first fluid inlet 66 and the first side 32 of the fluid channel 29. At step 904, a second fluid (different from the first fluid) is provided to the fluid chamber of the jetting dispenser. For example, the second fluid may be provided to the fluid chamber 62 of the dispenser 12 from the second fluid supply 31 via the second fluid inlet 67 and the second side 33 of the fluid channel 29.

At step 906, the first fluid and the second fluid are mixed in the fluid chamber to form a mixed fluid. For example, the first fluid and the second fluid may be mixed in the fluid chamber 62, at least in part, by the reciprocal movement of the poppet 26 and valve element 64 in the fluid chamber 62, as described above in relation to the embodiment shown in FIG. 2. As another example, the mixing of the first fluid and the second fluid in the fluid chamber 62 may be facilitated by static protrusions 80 disposed on the inner side walls 60 of the nozzle hub 20 and protruding into the fluid chamber 62, as described above in relation to the embodiment depicted in FIG. 4. As yet another example, the first and second fluids may be mixed, at least in part, by a reciprocal movement of the poppet 26 and valve element 64 and a rotational movement of the poppet 26 and valve element 64 about the longitudinal axis of the poppet 26, as described above in relation to the embodiment shown in FIG. 3. As a further example, the first and second fluids may be mixed, at least in part, by one or more static elements 82 (e.g., a cork screw surface) disposed on the surface of the poppet 26, as described above in relation to the embodiment of FIG. 5. As another example, the first and second fluids may be mixed, at least in part, by a rotation of at least a portion of the nozzle hub 20 and/or a rotating portion 84 of an inner cartridge body 58 of the dispenser 12, as described above in relation to the embodiment shown in FIG. 6. As yet another example, the first fluid and the second fluid may be mixed, at least in part, by the rotating member 90 situated in the fluid chamber 62 and rotated about the longitudinal axis of the poppet 26, as described above in relation to the embodiments depicted in FIGS. 7 and 8.

A valve element in the fluid chamber is reciprocally moved relative to a valve seat in the fluid chamber to cause a droplet of the mixed fluid to be jetted from a fluid outlet of the fluid dispenser. To illustrate and with attention again to FIGS. 1 and 2, the poppet 26 and the valve element 64 in the fluid chamber 62 may be reciprocally moved relative to the valve seat 22 in the fluid chamber 62 to cause a droplet of the mixed fluid 38 to be jetted, via the opening 70 in the valve seat 22, from the outlet 40 of the dispenser 12.

Although the disclosed systems and methods have been described in the context of a jetting dispenser in which the downward motion of a poppet and/or valve element toward a valve seat cause a droplet of fluid to be jet from a dispenser, the processes and principles described herein are equally applicable to other types of dispensers. For example, the processes and principles described herein may be applied to a dispenser in which the pressure of supplied fluid(s) causes the fluid(s) to be dispensed from the dispenser. In such a dispenser, a poppet, valve element, pin, needle, or the like may reciprocate within a fluid chamber to disengage with a valve seat and thereby allow the pressurized fluid(s) within the fluid chamber to be dispensed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A jetting dispenser, comprising:

a fluid chamber body defining a fluid chamber, a first fluid inlet providing a first fluid to the fluid chamber, a second fluid inlet providing a second fluid to the fluid chamber, and a fluid outlet;

a valve seat extending at least partially across the fluid outlet, the valve seat defining an opening in fluid communication with the fluid outlet;

a first metering device in fluid communication with the first fluid inlet, the first metering device being configured to control flow of the first fluid to the fluid chamber;

a second metering device in fluid communication with the second fluid inlet, the second metering device being configured to control flow of the second fluid to the fluid chamber, the jetting dispenser configured to combine the first and second fluids in the fluid chamber;

a valve element at least partially disposed within the fluid chamber, the valve element being movable towards and away from the valve seat; and a drive pin configured to move the valve element towards the valve seat to:

mix the first and second fluids within the fluid chamber into a mixed fluid; and cause a droplet of the mixed fluid to be jetted from the fluid outlet when the valve element contacts the valve seat, wherein, as the valve element is moved away from the valve seat, the valve element is disposed in and moves within the first and second fluids while the first and second fluids are combined in the fluid chamber to mix the first and second fluids within the fluid chamber, wherein the first metering device meters the first fluid independent of the second metering device that meters the second fluid to supply the first and second fluids to the fluid chamber according to a predetermined ratio.

2. The jetting dispenser of claim 1, wherein the fluid chamber body comprises a side wall and one or more protrusions disposed on the side wall.

3. The jetting dispenser of claim 1, wherein the valve element or the fluid chamber body rotates relative to the other to cause the mixing of the first fluid and the second fluid within the fluid chamber.

4. The jetting dispenser of claim 1, wherein the valve element comprises one or more static elements protruding from a surface of the valve element.

5. The jetting dispenser of claim 1, wherein the fluid chamber body comprises a rotating member such that the rotating member rotates circumferentially about the valve element.

6. The jetting dispenser of claim 5, wherein a surface of the rotating member comprises one or more static protrusions.

7. The jetting dispenser of claim 1, further comprising:

a fluid channel in fluid communication with the first fluid inlet and the second fluid inlet and providing the fluid chamber with the first fluid and the second fluid from the first fluid inlet and the second fluid inlet, respectively, wherein the first fluid inlet and the second fluid inlet are disposed on opposite sides of the fluid channel.

8. The jetting dispenser of claim 7, wherein the fluid channel is formed in a cylindrical shape and comprises a rotating member that rotates around a circumference of the fluid channel.

9. The jetting dispenser of claim 8, wherein the rotating member comprises one or more static elements protruding from an outer surface of the rotating member.

10. The jetting dispenser of claim 1, wherein the first metering device and the second metering device each comprise a pump.

11. The jetting dispenser of claim 1, wherein the first metering device and the second metering device each comprise a valve.

12. The jetting dispenser of claim 1, wherein the fluid chamber body or the valve element comprises one or more static protrusions to further aid the mixing of the first fluid and the second fluid into the mixed fluid.

13. The jetting dispenser of claim 1, wherein:

the first metering device further comprises a first sensor configured to measure a volume or flow rate of the first fluid being supplied to the first fluid inlet; and the second metering device further comprises a second sensor configured to measure a volume or flow rate of the second fluid being supplied to the second fluid inlet.

14. The jetting dispenser of claim 1, wherein:

the first metering device is positioned upstream of the first fluid inlet and downstream of a first fluid supply, and the second metering device is positioned upstream of the second fluid inlet and downstream of a second fluid supply.

15. The jetting dispenser of claim 1, further comprising a controller configured to control the first metering device to vary the flow of the first fluid to the fluid chamber and to control the second metering device to vary the flow of the second fluid to the fluid chamber to achieve the predetermined ratio of the first and second fluids supplied to the fluid chamber.

16. A method for dispensing a mixed fluid from a jetting dispenser having a fluid chamber body defining a fluid chamber, first and second fluid inlets, and a fluid outlet from the fluid chamber, a valve seat extending at least partially across the fluid outlet, the valve seat defining an opening in fluid communication with the fluid outlet, a first metering device in fluid communication with the first fluid inlet, a second metering device in fluid communication with the second fluid inlet, a valve element at least partially disposed within the fluid chamber, and a drive pin configured to move the valve element towards the valve seat, the method comprising:

controlling flow of a first fluid to the fluid chamber via the first fluid inlet using the first metering device;

controlling flow of a second fluid to the fluid chamber via the second fluid inlet using the second metering device, such that the first metering device meters the first fluid independent of the second metering device that meters the second fluid to supply the first and second fluids to the fluid chamber according to a predetermined ratio, the first and second fluids being combined in the fluid chamber;

moving the valve element away from the valve seat to mix the first fluid and the second fluid within the fluid chamber into the mixed fluid, the valve element being disposed in and moved within the first and second fluids while the first and second fluids are combined in the fluid chamber; and moving, via the drive pin, the valve element towards the valve seat to:

mix the first fluid and the second fluid within the fluid chamber into the mixed fluid; and cause jetting of a droplet of the mixed fluid from the fluid outlet when the valve element contacts the valve seat.

17. The method of claim 16, wherein moving the valve element relative to the valve seat to mix the first fluid and the second fluid comprises rotating the valve element or the fluid chamber body relative to one another.

18. The method of claim 16, wherein the valve element comprises one or more static elements protruding from a surface of the valve element.

19. The method of claim 16, wherein moving the valve element relative to the valve seat to mix the first fluid and the second fluid comprises rotating a rotating member circumferentially about the valve element.

20. The method of claim 16, wherein a surface of the rotating member comprises one or more static protrusions.

21. The method of claim 16, wherein the jetting dispenser further comprises a fluid channel in fluid communication with the first fluid inlet and the second fluid inlet and configured to provide the fluid chamber with the first fluid and the second fluid from the first fluid inlet and the second fluid inlet, respectively, and the first fluid inlet and the second fluid inlet are disposed on opposite ends of the fluid channel.

22. The method of claim 21, wherein the fluid channel is formed in a cylindrical shape and comprises a rotating member, the method further comprising:

rotating the rotating member around a circumference of the fluid channel.

23. The method of claim 22, wherein the rotating member comprises one or more static elements protruding from an outer surface of the rotating member.

24. The method of claim 16, wherein:

the first metering device and the second metering device each comprise a pump, controlling the flow of the first fluid to the fluid chamber via the first fluid inlet comprises pumping the first fluid to the fluid chamber via the first fluid inlet, and controlling the flow of the second fluid to the fluid chamber via the second fluid inlet comprises pumping the second fluid to the fluid chamber via the second fluid inlet.

25. The method of claim 16, wherein:

the first metering device and the second metering device each comprise a valve, controlling the flow of the first fluid to the fluid chamber via the first fluid inlet comprises starting and stopping the flow of the first fluid to the fluid chamber via the first fluid inlet, and controlling the flow of the second fluid to the fluid chamber via the second fluid inlet comprises starting and stopping the flow of the second fluid to the fluid chamber via the second fluid inlet.

26. The method of claim 16, wherein the fluid chamber body or the valve element comprises one or more static protrusions to further aid the mixing of the first fluid and the second fluid into the mixed fluid.

27. The method of claim 16, wherein the first metering device further comprises a first sensor and the second metering device further comprises a second sensor, the method further comprising:

measuring a volume or flow rate of the first fluid being supplied to the first fluid inlet; and measuring a volume or flow rate of the second fluid being supplied to the second fluid inlet.

28. The method of claim 16, wherein:

the first metering device is positioned upstream of the first fluid inlet and downstream of a first fluid supply, and the second metering device is positioned upstream of the second fluid inlet and downstream of a second fluid supply, controlling the flow of the first fluid to the fluid chamber via the first fluid inlet using the first metering device comprises supplying the first fluid from the first fluid supply through the first metering device and into the first fluid inlet, and controlling the flow of the second fluid to the fluid chamber via the second fluid inlet using the second metering device comprises supplying the second fluid from the second fluid supply through the second metering device and into the second fluid inlet.

29. The method of claim 16, wherein:

the jetting dispenser further comprises a controller, controlling the flow of the first fluid to the fluid chamber via the first fluid inlet using the first metering device comprises controlling the first metering device using the controller to vary the flow of the first fluid to the fluid chamber, and controlling the flow of the second fluid to the fluid chamber via the second fluid inlet using the second metering device comprises controlling the second metering device using the controller to vary the flow of the second fluid to the fluid chamber.

30. A dispenser for fluid materials, the dispenser comprising:

a fluid chamber body defining a fluid chamber, a first fluid inlet providing a first fluid to the fluid chamber, a second fluid inlet providing a second fluid to the fluid chamber, and a fluid outlet;

a valve seat extending at least partially across the fluid outlet, the valve seat defining an opening in fluid communication with the fluid outlet;

a first metering device in fluid communication with the first fluid inlet, the first metering device being configured to control flow of the first fluid to the fluid chamber;

a second metering device in fluid communication with the second fluid inlet, the second metering device being configured to control flow of the second fluid to the fluid chamber, the jetting dispenser configured to combine the first and second fluids in the fluid chamber;

a valve element at least partially disposed within the fluid chamber, the valve element being movable towards and away from the valve seat; and a drive pin configured to move the valve element towards the valve seat to:

mix the first and second fluids within the fluid chamber into a mixed fluid; and cause the mixed fluid to be dispensed from the fluid outlet, wherein, as the valve element is moved away from the valve seat, the valve element is disposed in and moves within the first and second fluids while the first and second fluids are combined in the fluid chamber to mix the first and second fluids within the fluid chamber, wherein the first metering device meters the first fluid independent of the second metering device that meters the second fluid to supply the first and second fluids to the fluid chamber according a predetermined ratio.

31. The dispenser of claim 30, wherein the fluid chamber body comprises a side wall and one or more protrusions disposed on the side wall.

32. The dispenser of claim 30, wherein the valve element or the fluid chamber body rotates relative to the other to cause the mixing of the first fluid and the second fluid within the fluid chamber.

33. The dispenser of claim 30, wherein the valve element comprises one or more static elements protruding from a surface of the valve element.

34. The dispenser of claim 30, wherein the fluid chamber body comprises a rotating member such that the rotating member rotates circumferentially about the valve element.

35. The dispenser of claim 34, wherein a surface of the rotating member comprises one or more static protrusions.

36. The dispenser of claim 30, further comprising:

a fluid channel in fluid communication with the first fluid inlet and the second fluid inlet and providing the fluid chamber with the first fluid and the second fluid from the first fluid inlet and the second fluid inlet, respectively, wherein the first fluid inlet and the second fluid inlet are disposed on opposite sides of the fluid channel.

37. The dispenser of claim 36, wherein the fluid channel is formed in a cylindrical shape and comprises a rotating member that rotates around a circumference of the fluid channel.

38. The dispenser of claim 37, wherein the rotating member comprises one or more static elements protruding from an outer surface of the rotating member.

39. The dispenser of claim 30, wherein the first metering device and the second metering device each comprise a pump.

40. The dispenser of claim 30, wherein the first metering device and the second metering device each comprise a valve.

41. The dispenser of claim 30, wherein the fluid chamber body or the valve element comprises one or more static protrusions to further aid the mixing of the first fluid and the second fluid into the mixed fluid.

42. The dispenser of claim 30, wherein:

the first metering device further comprises a first sensor configured to measure a volume or flow rate of the first fluid being supplied to the first fluid inlet; and the second metering device further comprises a second sensor configured to measure a volume or flow rate of the second fluid being supplied to the second fluid inlet.

43. The dispenser of claim 30, wherein:

the first metering device is positioned upstream of the first fluid inlet and downstream of a first fluid supply, and the second metering device is positioned upstream of the second fluid inlet and downstream of a second fluid supply.

44. The jetting dispenser of claim 30, further comprising a controller configured to control the first metering device to vary the flow of the first fluid to the fluid chamber and to control the second metering device to vary the flow of the second fluid to the fluid chamber to achieve the predetermined ratio of the first and second fluids supplied to the fluid chamber.

* * * * *